US012290224B2

(12) United States Patent
Billings et al.

(10) Patent No.: US 12,290,224 B2
(45) Date of Patent: May 6, 2025

(54) PET HAIR REMOVER

(71) Applicant: Black & Decker, Inc., New Britain, CT (US)

(72) Inventors: Ross A. Billings, Reisterstown, MD (US); Tylan A. Tschopp, Baltimore, MD (US); Cory Czarnik, Baltimore, MD (US); Aldon Blackwood, Baltimore, MD (US); Zoumin Huang, Suzhou (CN); Qin Zou, Irvine, CA (US); Caroline Elaine Dodson, Baltimore, MD (US); Yonghong Wang, Suzhou (CN); Zhilin Pan, Nantong (CN)

(73) Assignee: Black & Decker, Inc., New Britain, CT (US)

( * ) Notice: Subject to any disclaimer, the term of this patent is extended or adjusted under 35 U.S.C. 154(b) by 272 days.

(21) Appl. No.: 17/820,666

(22) Filed: Aug. 18, 2022

(65) Prior Publication Data

US 2024/0057841 A1 Feb. 22, 2024

(51) Int. Cl.
*A47L 13/40* (2006.01)

(52) U.S. Cl.
CPC ..... *A47L 13/40* (2013.01)

(58) Field of Classification Search
CPC .... A47L 13/40; A47L 13/42; A47L 13/51–52; A47L 25/005; A46B 13/08; A46B 15/002; A46B 2200/3053
USPC ..... 15/1.51
See application file for complete search history.

(56) References Cited

U.S. PATENT DOCUMENTS

| | | | | |
|---|---|---|---|---|
| 4,765,012 | A | 8/1988 | Ueda | |
| 8,117,706 | B2 | 2/2012 | Sato | |
| 10,874,207 | B1 | 12/2020 | Wengreen | |
| 2009/0223006 | A1 * | 9/2009 | Sato | A46B 13/001 15/52.1 |
| 2014/0053356 | A1 * | 2/2014 | Tawara | B25G 3/38 15/144.4 |

(Continued)

FOREIGN PATENT DOCUMENTS

| | | | | |
|---|---|---|---|---|
| CN | 111067465 A | * | 4/2020 | A47L 25/005 |
| CN | 215584077 U | * | 1/2022 | |

(Continued)

OTHER PUBLICATIONS

ChomChom Roller (2022). Retrieved from the Wayback Machine Archive located at <https://www.amazon.com/stores/ChomChomRoller/page/EABEA501-9F08-4F7D-805E-676095AD6B5B?ref_=ast_bin>, last visited Jul. 5, 2022, 5 pages.

*Primary Examiner* — Eric J Rosen
*Assistant Examiner* — Aaron R McConnell
(74) *Attorney, Agent, or Firm* — Morrison & Foerster LLP

(57) ABSTRACT

Pet hair removers are disclosed herein. In some embodiments, the pet hair remover includes a handle, a collection chamber, a roller, a roller frame, a door, and a blade. In some embodiments, the pet hair remover comprises a protrusion on an exterior, planar surface of the roller, and the roller's rotation is limited by the protrusion contacting the roller frame. In some embodiments, the door is at least partially transparent to provide a view of the collection chamber. In some embodiments, the pet hair remover further comprises a spring that biases the door open, a latch that holds the door closed, and a button on the handle.

18 Claims, 8 Drawing Sheets

(56) References Cited

U.S. PATENT DOCUMENTS

| | | | | |
|---|---|---|---|---|
| 2019/0159648 | A1 | 5/2019 | Favia et al. | |
| 2019/0246780 | A1* | 8/2019 | Jungnickel | H01R 13/6276 |
| 2021/0369073 | A1* | 12/2021 | Wengreen | A47L 11/4013 |
| 2022/0007911 | A1 | 1/2022 | Ono et al. | |
| 2022/0386843 | A1* | 12/2022 | Kaleta | A47L 13/42 |

FOREIGN PATENT DOCUMENTS

| | | | | | |
|---|---|---|---|---|---|
| CN | 219229792 | U | * | 6/2023 | A47L 13/10 |
| EP | 1476065 | B1 | | 4/2010 | |
| EP | 1468638 | B1 | | 1/2011 | |
| EP | 2823730 | B1 | | 9/2018 | |
| GB | 2576991 | A | | 3/2020 | |
| JP | 5742528 | B2 | | 5/2015 | |
| WO | 2018195470 | A1 | | 10/2018 | |
| WO | 2020230841 | A1 | | 11/2020 | |

* cited by examiner

PET HAIR REMOVER

TECHNICAL FIELD

This disclosure generally relates to a device for removing waste from a surface.

BACKGROUND

Pet hair may be a nuisance for owners. It may be difficult to remove pet hair from a surface (e.g., carpet, furniture) because the pet hair may stick to the surface. A device generating static electricity, which may be more cost effective than a vacuum cleaner or disposable adhesive rollers, may be used to remove pet hair from the surface. A user may create static electricity by rubbing the device back and forth against the surface, and the electrostatic force causes the pet hair to detach from the surface and attach to the device. The pet hair attached to the device may be transferred into a chamber of the device via a roller of the device, and the collected pet hair may be disposed at a later time.

SUMMARY

Pet hair removers are disclosed herein. In some embodiments, a pet hair remover includes a handle, a collection chamber, a roller, a roller frame, a door, and a blade. A user may move the pet hair remover back and forth on a surface, causing the roller to rub back and forth against the surface to generate static electricity for picking up pet hair.

In some embodiments, the pet hair remover includes a protrusion on an exterior planar surface of the roller, and the roller's rotation is limited by the protrusion contacting the roller frame. In some embodiments, the pet hair remover does not have a protrusion on the underside of the door that limits rotation of the roller. This arrangement may advantageously allow the door to be at least partially transparent and provide a view of the collection chamber, thereby providing the user a view of the collection chamber and the ability to determine whether the collection chamber is full without opening the door. Furthermore, the volume of the collection chamber may be increased. In some embodiments, the pet hair remover reduces a risk of unintentional opening of the door to the collection chamber. In some embodiments, the handle of the pet hair remover conforms to a hand of the user holding the pet hair remover.

In some embodiments, the handle is fixed relative to the collection chamber and the roller. The roller frame is configured to fix the roller in an axis of rotation, and the roller is positioned between the sides of the roller frame. The door is configured for accessing the collection chamber, and the collection chamber is bounded, at least in part, by an interior surface of the door and an interior surface of the roller. The blade is on an exterior, curvilinear surface of the roller.

The embodiments disclosed above are only examples, and the scope of this disclosure is not limited to them. Particular embodiments may include all, some, or none of the components, elements, features, functions, operations, or steps of the embodiments disclosed above. Embodiments according to the invention are in particular disclosed in the attached claims directed to a method, a device, and a system, wherein any feature mentioned in one claim category, e.g. device, can be claimed in another claim category, e.g. method, as well. The dependencies or references back in the attached claims are chosen for formal reasons only. However any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed includes not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

DESCRIPTION OF EXAMPLE EMBODIMENTS

Pet hair removers are disclosed herein. In some embodiments, the pet hair remover's roller rotation is limited by a protrusion on an exterior surface of the roller, reducing a thickness of the pet hair remover's door and increasing a volume of the pet hair remover's collection chamber. In some embodiments, the pet hair remover provides a view of its collection chamber for a user to determine whether the collection chamber is full. In some embodiments, the pet hair remover reduces a risk of unintentional opening of a collection door. In some embodiments, the pet hair remover's handle conforms to a user's hand.

Figure 1:
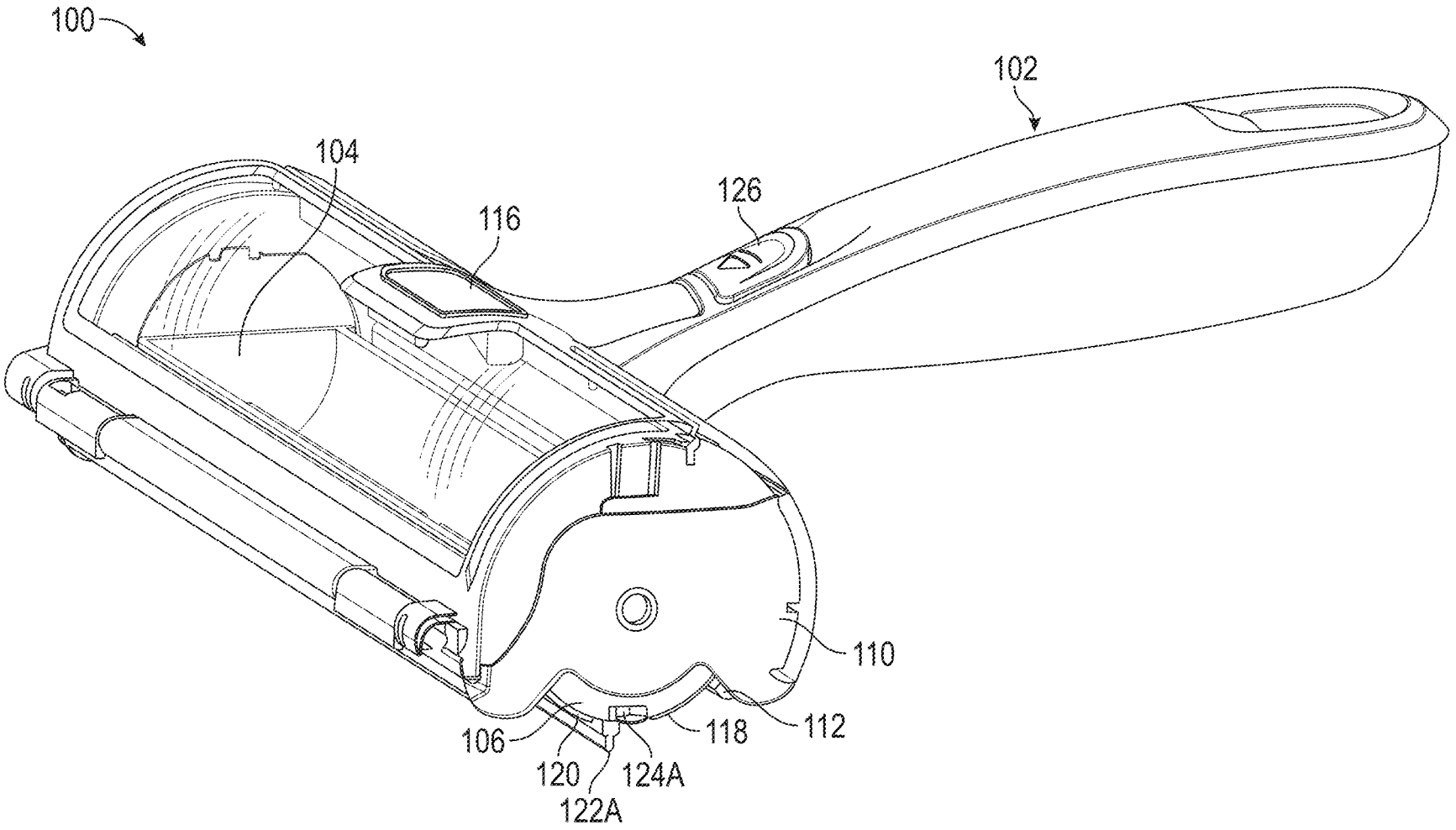
FIG. 1 illustrates an isometric view of an example pet hair remover.

FIG. 1 illustrates an isometric view of an example pet hair remover 100. In some embodiments, the pet hair remover 100 includes a handle 102, a collection chamber 104, a roller 106, wheels 108A and 108B (shown in subsequent figures), a roller frame 110, first arm 112, second arm 114 (shown in subsequent figures), a door 116, first hair collection textile 118, second hair collection textile 120, first blade 122A, first protrusion 124A, and button 126. In some embodiments, as illustrated herein, the handle 102 is fixed relative to the collection chamber 104, the roller 106, and the wheels 108A and 108B. In some embodiments, a sheet of textile covers an exterior portion of the roller 106 to form the first hair collection textile 118 and second hair collection textile 120.

In some embodiments, the first protrusion 124A positioned on the exterior surface of the roller allows the door 116 to be slimmer. In some embodiments of pet hair remover 100, the thickness of the door does not exceed 9.7 mm. For example, a radius of the surface facing away from the collection chamber of the semi-cylindrical door 116 is 28.7 mm, and a radius of the surface facing away from the collection chamber of semi-cylindrical roller 106 is 19 mm, so the thickness of the door 116 is 9.7 mm. In some embodiments, an inner surface of the door 116 is configured to not interfere with a rotation of the roller 106. That is, if the protrusion were not on the roller, the roller would fully rotate, and the inner surface of the door 116 would not interfere with its rotation. The door thickness and/or inner surface characteristics may advantageously allow the door 116 to be at least partially transparent and provide a view of the collection chamber 104, thereby providing the user a view of the collection chamber 104 and the ability to determine whether the collection chamber 104 is full without opening the door 116, which, in some embodiments, provides access to the collection chamber 104. In some embodiments, the pet hair remover 100 reduces a risk that a user unintentionally opens the door 116 to the collection chamber 104. In some embodiments, the handle 102 of pet hair remover conforms to a hand of the user holding the pet hair remover advantageously providing a more ergonomic and comfortable user experience. In some embodiments, the collection chamber 104 is bounded, at least in part, by an interior surface of the door 116 (e.g., a surface of the door 116 facing the roller 106) and an interior surface of the roller 106 (e.g., a surface of the roller 106 facing the door 116). In some embodiments, because the door 116 may be slimmer, collection chamber 104 volume may be increased.

Figure 2:
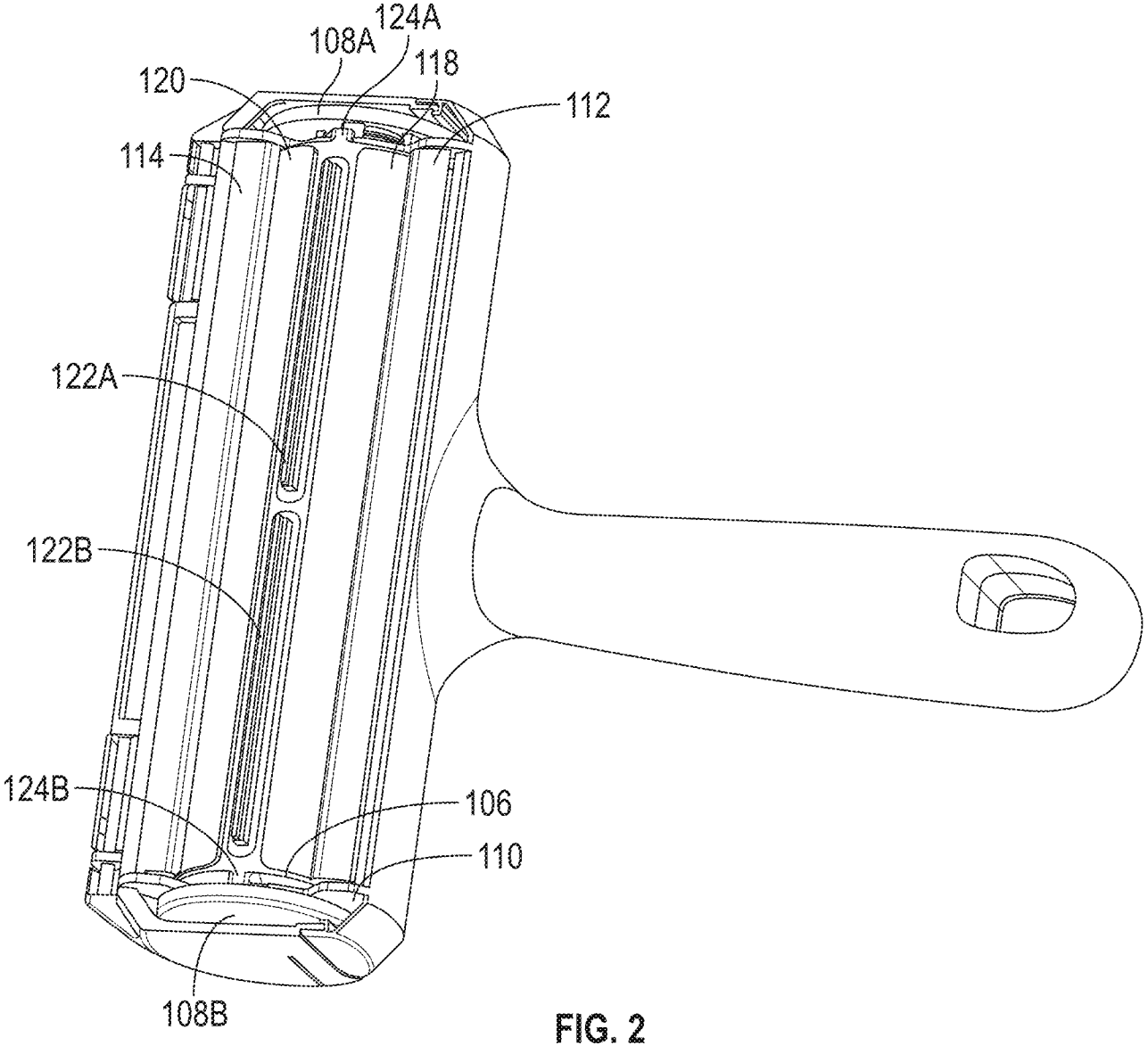
FIG. 2 illustrates a bottom view of an example pet hair remover.
Figure 3:
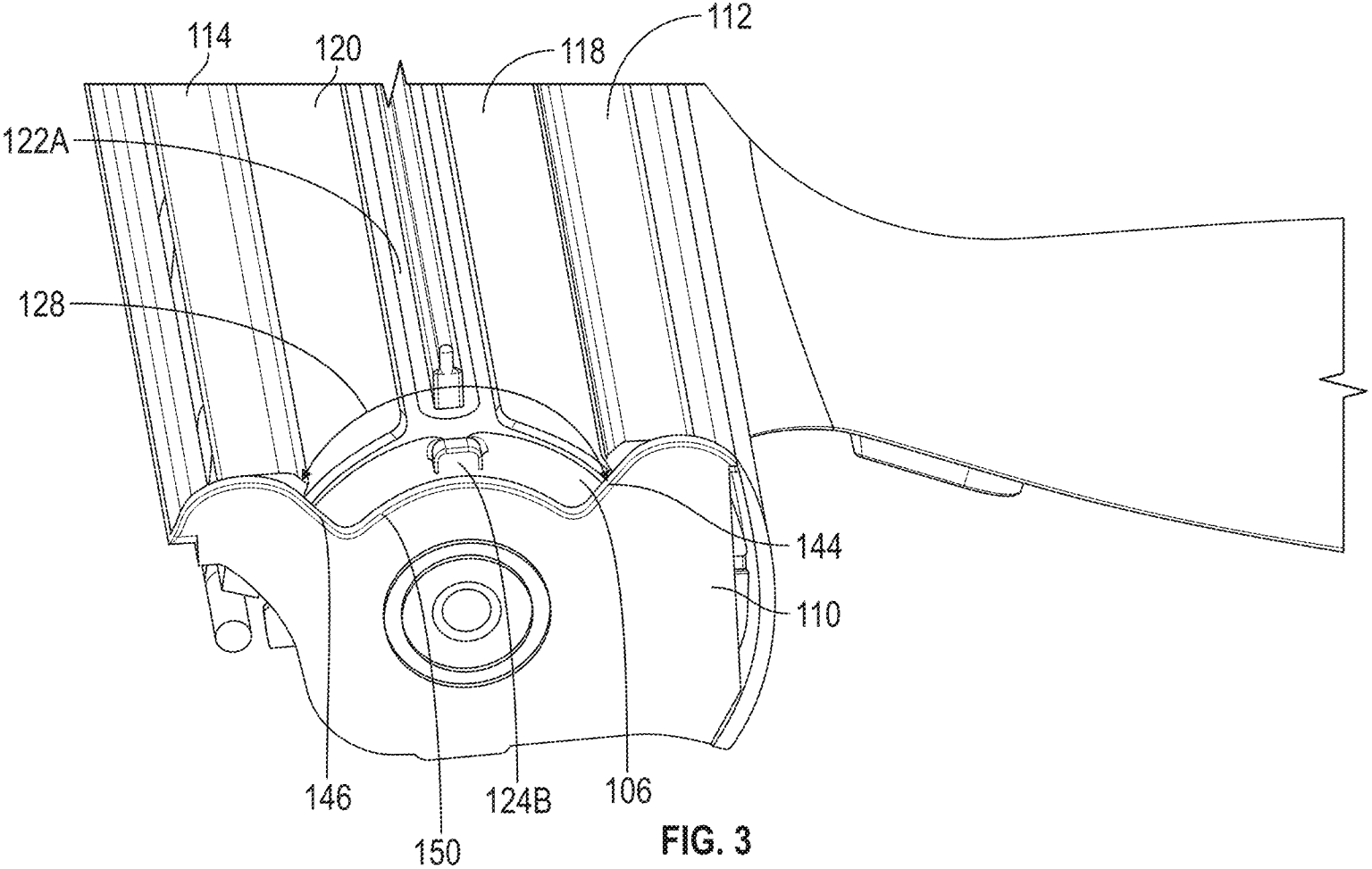
FIG. 3 illustrates a roller frame and protrusion of an example pet hair remover.

In some embodiments, the first hair collection textile 118 and the second hair collection textile 120 are on an exterior, curvilinear surface of the roller 106 (e.g., as illustrated in FIGS. 2 and 3). In some embodiments, the first hair collection textile 118 contacts the first arm 112, and the second hair collection textile 120 contacts the second arm 114 (as illustrated in FIGS. 2 and 3). In some embodiments, the first arm 112 includes a textile, and the second arm 114 includes a textile. In some embodiments, the first arm 112 and the second arm 114 comprise a same material as the first and second textiles 118 and 120. In some embodiments, the first arm 112 and the second arm 114 comprise a different material as the first and second textiles 118 and 120. In some embodiments, as described in more detail herein, the hair collection textile contacts a respective arm to transfer pet hair from the textile to the collection chamber 104.

A user may move the pet hair remover 100 back and forth on a surface, causing the roller 106 to move back and forth against the first arm 112 and the second arm 114 and/or the surface to generate static electricity for picking up pet hair. For example, the motion of the first hair collection textile 118 and the second hair collection textile 120 and their respective contact with the first arm 112 and the second arm 114 generate the static electricity. As another example, the static electricity is generated on first hair collection textile 118 and/or second hair collection textile 120 by moving the pet hair remover 100 back and forth on a dielectric surface. In some embodiments, the first hair collection textile 118 and/or the second hair collection textile 120 include a dielectric material configured to generate static electricity (e.g., short pile polyester textile) when the textile rubs against a dielectric surface (e.g., carpet, cloth).

In some embodiments, the roller frame 110 is configured to fix the roller 106 in an axis of rotation (e.g., the roller 106 attaches to the roller frame 110 at two points of the roller frame along the axis of rotation), and the roller frame 110 is positioned between the roller 106 and a first wheel 108A (such that the roller 106 is positioned between sides of the roller frame 110). In some embodiments, as illustrated in FIG. 2, the pet hair remover 100 includes a second wheel 108B. In some embodiments, the first arm 112 and the second arm 114 are coupled to the roller frame 110 and parallel to the axis of rotation of the roller 106.

In some embodiments, the pet hair remover 100 includes a first protrusion 124A on an exterior planar surface of the roller, and the roller's rotation is limited by the protrusion contacting the roller frame. For example, as shown in FIGS. 2 and 3, the first protrusion 124A and/or the second protrusion 124B limit the roller 106 to rotation 128 by contacting the roller frame 110 on a side of the first arm 112 (e.g., at a first edge 144 of the roller frame 110) and on a side of the second arm 114 (e.g., at a second edge 146 of the roller frame 110). In some embodiments, the first edge 144 and the second edge 146 intersect an intermediate edge 150 to form a cutout to allow the protrusion to rotate between the first and second edges. That is, the intersection between the first edge 144 and a tangent line of intermediate edge 150 at the intersection point form an angle between 0 and 180 degrees, and the intersection between the second edge 146 and a tangent line of intermediate edge 150 at the intersection point form an angle between 0 and 180 degrees. In some embodiments, the protrusion is configured to rotate around an intermediate edge 150 of the roller frame between the first edge 144 and the second edge 146, and the intermediate edge 150 is in an arc shape concentric to the roller's rotation 128. In some embodiments, the rotation 128 is 90 degrees. It should be appreciated that the first, second, and intermediate edges may be in a shape different than illustrated. For example, the intermediate edge may comprise an oval arc shape or a straight line.

In some embodiments, the pet hair remover 100 includes a second protrusion 124B on a second exterior planar surface of the roller, as illustrated in FIG. 2, and the roller's rotation is further limited by the second protrusion contacting the roller frame 110 (e.g., at a third and fourth point (e.g., symmetric to the first and second points about a center of the roller frame) on the roller frame 110). In some embodiments, the second protrusion 124B supplements the first protrusion 124A by performing similar functionalities and having similar features as the first protrusion 124A.

By contacting the roller frame 110 to limit the rotation of the roller 106, the first protrusion 124A positioned on the exterior surface of roller 106 allows the door 116 to be slimmer. In some embodiments of pet hair remover 100, the thickness of the door does not exceed 9.7 mm. This arrangement may advantageously allow the door 116 to be at least partially transparent (e.g., the door 116 includes a window) and provide a view of the collection chamber 104, thereby providing the user a view of the collection chamber and the ability to determine whether the collection chamber 104 is full without opening the door 116 (e.g. allowing the user to clean the pet hair remover before the collection chamber becomes too full and pet hair in the collection chamber exits via the arms). In some embodiments, because the door 116 may be slimmer, collection chamber 104 volume may be increased.

In some embodiments, the first blade 122A is on an exterior, curvilinear surface of the roller 106 (e.g., as illustrated in FIGS. 1-5). In some embodiments, the first blade 122A is a rubber blade. In some embodiments, the first blade 122A comprises a non-rubber material, such as plastic. In some embodiments, the first blade 122A is positioned between the first hair collection textile 118 and the second hair collection textile 120 on the exterior, curvilinear surface of the roller 106 (e.g., as illustrated in FIGS. 2-4). In some embodiments, the pet hair remover 100 includes a second blade 122B positioned between the first hair collection textile 118 and the second hair collection textile 120, as illustrated in FIG. 2. In some embodiments, the second blade 122B supplements the first blade 122A by performing similar functionalities and having similar features as the first blade 122A. In some embodiments, the surface areas of the first hair collection textile 118 and the second area hair collection textile 120 are the same, and the blades 122A and 122B are positioned between the textiles to increase an amount of pet hair being transferred to the collection chamber 104, compared to collection textiles that have different surface areas. In some embodiments, the blades 122A and 122B are configured to transfer pet hair to the collection chamber 104 by sweeping the pet hair into the collection chamber. Although the pet hair remover 100 is illustrated as comprising two blades, it should be appreciated that the pet hair remover 100 may comprise one blade for performing operations described with respect to the first blade 122A and second blade 122B.

In some embodiments, the first blade 122A is aligned with the first protrusion 124A along a radius of the exterior, planar surface of the roller 106. For example, the roller 106 is in a shape of a semi-cylinder, and the first blade 122A is aligned with the first protrusion 124A along a radius of the semi-cylinder on the exterior, planar surface of the semi-cylinder. Aligning the first blade 122A with first protrusion 124A along a radius of the exterior, planar surface of the roller 106 may reduce a distance between the blade 122 and an arm 112 or 114 when the roller 106 is at an end of its rotation and increase an amount of pet hair transferred to the collection chamber 104, compared to a blade and a protrusion that do not align along the radius.

In some embodiments, the roller's rotation is limited by the first blade 122A contacting the first and second arms 112 and 114, respectively. For example, the roller's rotation is limited by the blade 122A contacting the first arm 112 and the second arm 114, in addition to the first protrusion 124A contacting the roller frame 110. As another example, the roller's rotation is limited by the blade 122A contacting the first arm 112 and the second arm 114, in lieu of the first protrusion 124A contacting the roller frame 110. In some embodiments, the roller's rotation is not limited by the blade contacting the first and second arms (e.g., the first blade 122A does not contact the first or second arm while the roller is rotating). In a preferred embodiment, the first protrusion 124A limits rotation of the roller 106 such that the first blade 122A is adjacent the first and second arms at the end of the roller's rotation. This configuration may advantageously increase transfer of pet hair to the collection chamber 104.

In some embodiments, the first blade 122A is coupled to the roller 106 and configured to cause the roller 106 to rotate (e.g., pivot the roller 106). For example, the roller 106 is in a first position (as shown in FIG. 4A), such that the first blade 122A is adjacent to first arm 112 and the first protrusion 124A contacts a first point of the roller frame 110. If a user moves the pet hair remover 100 backward (e.g., a direction from the second arm 114 to the first arm 112) against a surface, a force between the first blade 122A and the surface would cause the roller 106 to rotate, such that the first blade 122A rotates toward the second arm 114. In some embodiments, as described above, as the first blade 122A rotates toward the second arm 114, the first hair collection textile 118 rubs against the surface and generates static electricity for collecting pet hair. In some embodiments, hair collected on second hair collection textile 120 is transferred into the collection chamber 104 (e.g., the second arm 114 is configured to detach hair (e.g., brush hair off the collection textile) from the second hair collection textile 120 as the roller 106 is rotating, thus allowing the detached hair to be deposited into the collection chamber 104 (e.g., first blade 122A pushes the hair detached by the arm into the collection chamber 104, the motion of the roller 106 transfers the hair detached by the arm into the collection chamber). After the rotation of the roller 106 is limited (e.g., the first protrusion 124A contacts the roller frame 110), the user may continue to move the pet hair remover 100 backward to further generate static electricity on the first hair collection textile 118.

Figure 4B:
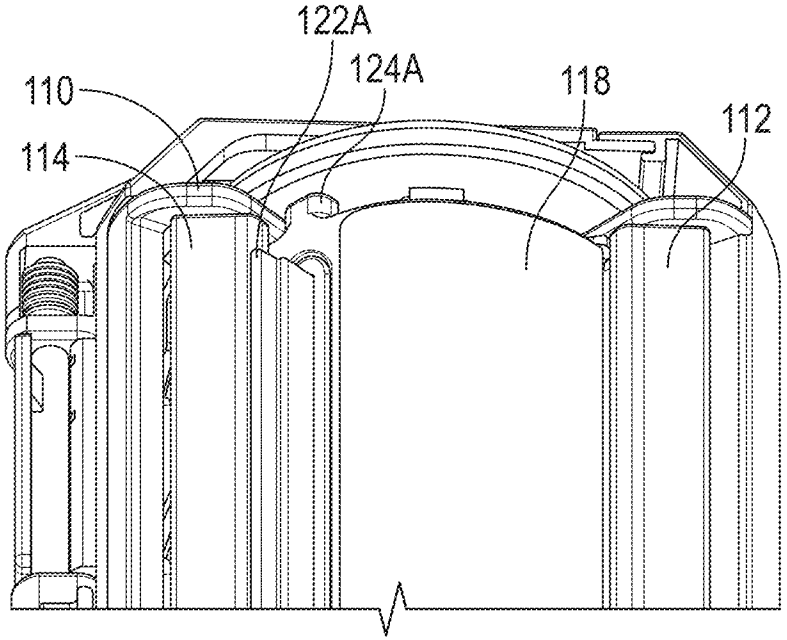
FIGS. 4A and 4B illustrate a roller frame and protrusion of an example pet hair remover.
Figure 4A:
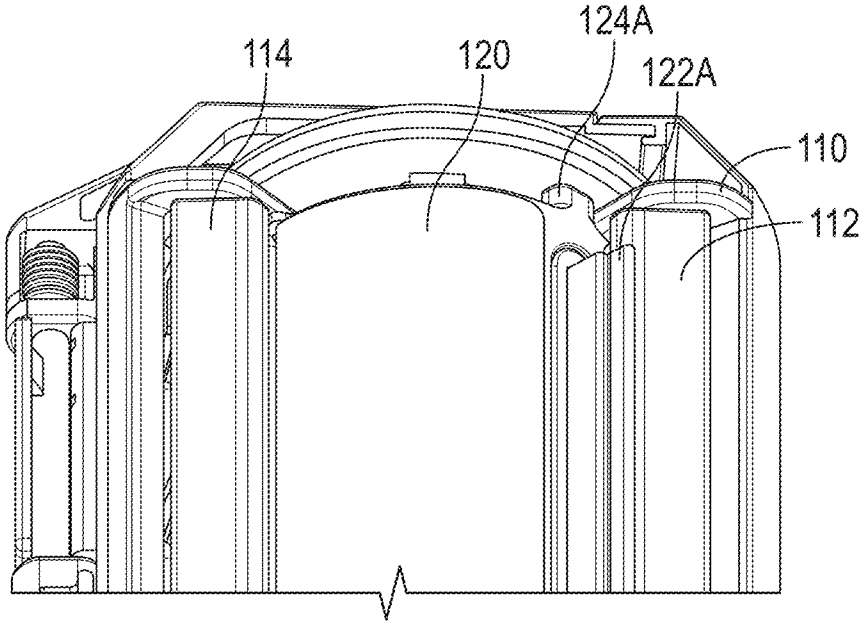

As another example, the roller 106 is in a second position (as shown in FIG. 4B), such that the first blade 122A is adjacent to second arm 114 and the first protrusion 124A contacts a second point of the roller frame 110. If a user moves the pet hair remover 100 forward (e.g., a direction from the first arm 112 to the second arm 114) against a surface, a force between the first blade 122A and the surface would cause the roller 106 to rotate, such that the first blade 122A rotates toward the first arm 112. In some embodiments, as described above, as the first blade 122A rotates toward the first arm 112, the second hair collection textile 120 rubs against the surface and generates static electricity for collecting pet hair. In some embodiments, hair collected on first hair collection textile 118 is transferred into the collection chamber 104 (e.g., the first arm 112 is configured to detach hair (e.g., brush hair off the collection textile) from the first hair collection textile 118 as the roller 106 is rotating and allow the detached hair to be deposited into the collection chamber 104 (e.g., first blade 122A pushes the hair detached by the arm into the collection chamber 104, the motion of the roller 106 transfers the hair detached by the arm into the collection chamber). After the rotation of the roller 106 is limited (e.g., the first protrusion 124A contacts the roller frame 110), the user may continue to move the pet hair remover 100 forward to further generate static electricity on the second hair collection textile 120.

Figure 5:
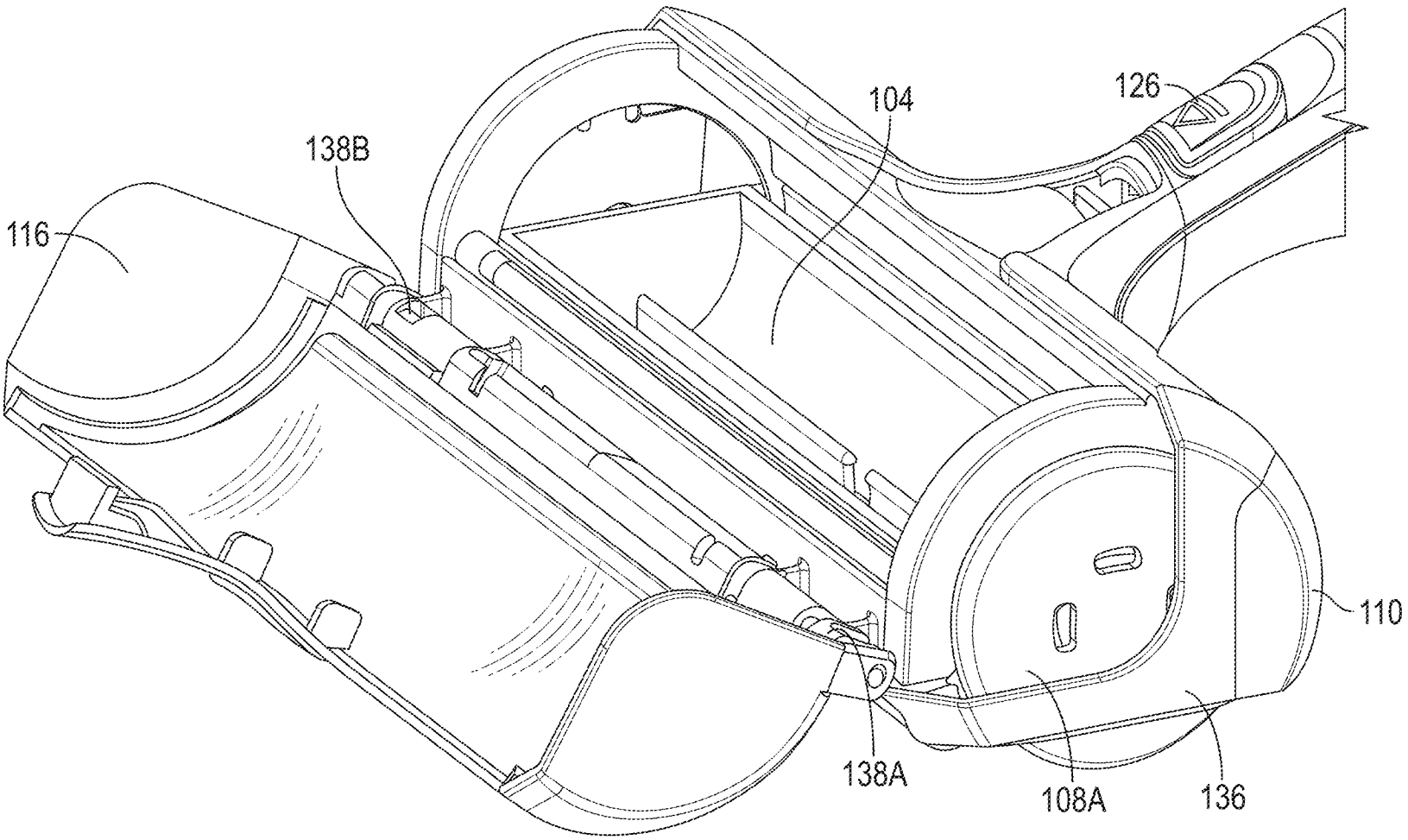
FIG. 5 illustrates a collection chamber of an example pet hair remover.

FIG. 5 illustrates a collection chamber 104 of an example pet hair remover 100. In some embodiments, as illustrated, the door 116 is configured to open to allow access to the collection chamber 104 (e.g., for collecting pet hair transferred from the collection textiles, as described herein). In some embodiments, the pet hair remover 100 includes a torsional spring 138A for biasing the door 116 open. For example, the torsional spring 138A couples to a side of the door 116 for biasing the door open, as illustrated. In some embodiments, the pet hair remover 100 includes a second torsional spring 138B for biasing the door 116 open. In some embodiments, the pet hair remover 100 includes an outer housing 136, and the outer housing includes an interference to limit an opening of the door. For example, the interference is a portion of the outer housing that extends into a path of the door's rotation, impeding the door 116 from opening further by counteracting the force of the torsional springs 138A and/or 138B. In some embodiments, as illustrated, the door 116 includes walls on its side to cover the wheels 108A and 108B when the door is closed. This may advantageously cover the wheels from damage and/or keep debris away from rotational surfaces.

Figure 6:
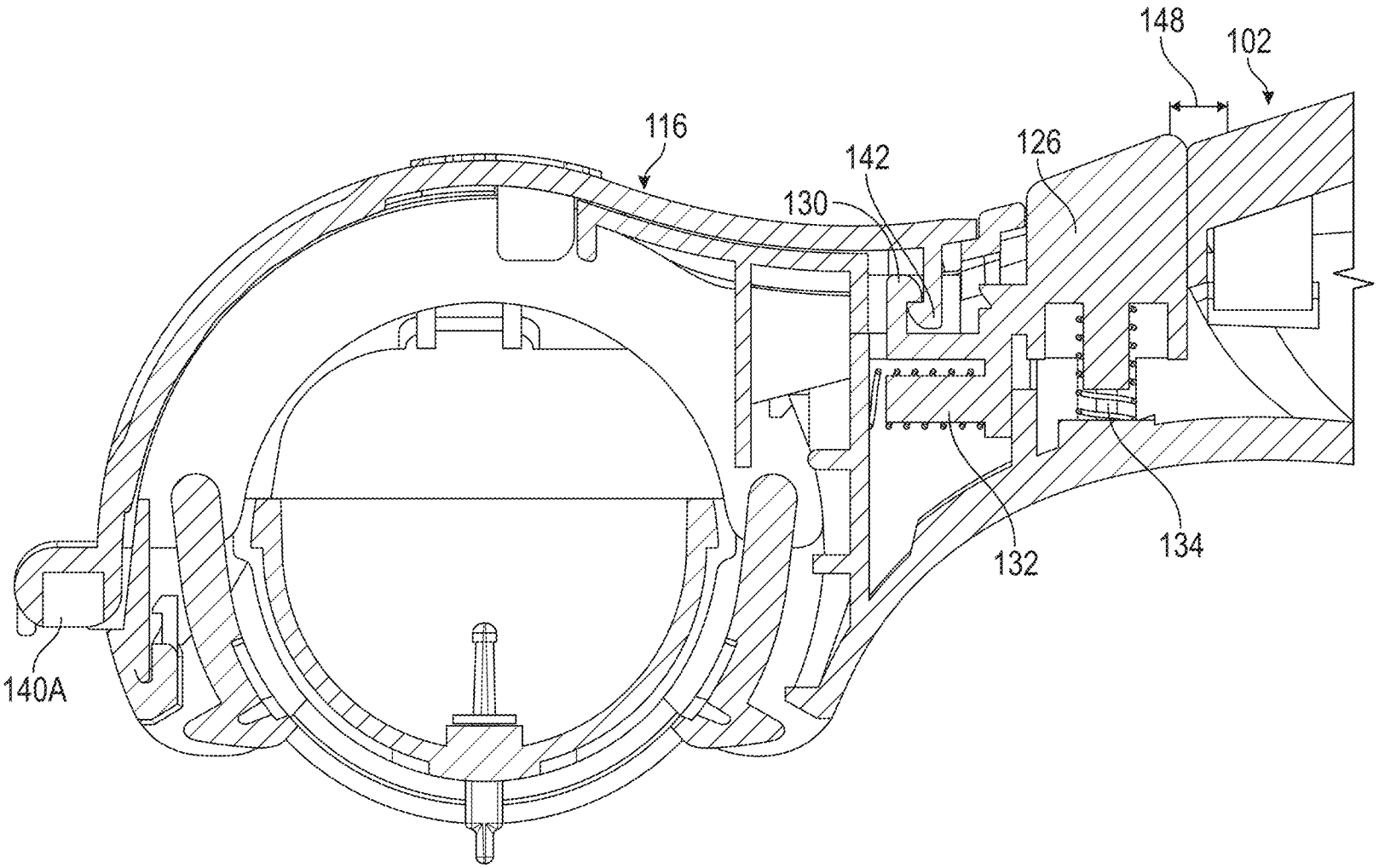
FIG. 6 illustrates a cross-section view of an example pet hair remover.

FIG. 6 illustrates a cross-section view of an example pet hair remover 100. In some embodiments, the pet hair remover 100 includes a latch 130, spring 132, and spring 134. In some embodiments, the latch 130 is configured to hold the door 116 closed. In some embodiments, the button 126 is on the handle 102. In some embodiments, the latch 130 is adjacent to the handle 102, as illustrated. In some embodiments, the button 126 is positioned such that a maximum height of the button is at or below a height of the surface of the handle 102. In some embodiments, the maximum height of the button is above the surface of the handle 102 in a portion of the handle adjacent to the button. This arrangement, illustrated in the cross-section view of FIG. 6, may advantageously improve a user's ability to press and activate the button. At a distance 148 away from the maximum height, the maximum height of the button is at or below the surface of the handle 102. This arrangement, again illustrated in the cross-section view of FIG. 6, can advantageously reduce risk of accidental contact, by a user, of the button and unintentional opening of the door, while allowing the user to access the button for opening the door. In some embodiments, distance 148 is 1-4 mm. The distance 148 may, in some embodiments, be a location on the handle where the maximum height of the button is the same level as the height of the handle. In these embodiments, a height of the handle and a height of the button can be understood to be measured in a direction of activation of button 102. In such embodiments, distance 148 is measured in a direction orthogonal to a direction of activation of button 102. The distance 148 may also, in some embodiments, orthogonal to the axis of a roller, such as roller 106. In some embodiments, an exterior of the button 126 tapers toward the door, as illustrated (e.g., reducing risk of accidental contact of the button and unintentional opening of the door, compared to a button that does not taper). In some embodiments, the tapering and/or the button positioning allow the handle to conform to a hand of the user while holding the pet hair remover, advantageously providing a more ergonomic and comfortable user experience.

In some embodiments, the button 126 is movable to release the latch 130. For example, the latch 130 is released after the button 126 is pushed. In some embodiments, the spring 132 is coupled to the latch 130, and the spring 134 is coupled to the button 126. In some embodiments, as illustrated, the spring 132 and the spring 134 are in their extended positions, and, in their extended positions, the spring 132 and the spring 134 are configured to cause the latch 130 to hold the door 116 to close.

For example, as illustrated, the spring 132, at the extended position, exerts a force on the latch 130 toward door catch 142, counteracting against a force of the torsional springs 138A and/or 138B to hold the door 116 closed. In some embodiments, when button 126 is pushed beyond a threshold distance, the button 126 pushes the latch 130 away from the door catch 142, reducing or removing the force counteracting the torsional springs 138A and/or 138B and causing the door 116 to open, as illustrated in FIG. 5. The springs 132 and 134 advantageously allow the door 116 to remain close until the button 126 is pushed beyond a threshold distance, reducing a risk of the door 116 opening by accidental contact with the button 126.

Figure 7:
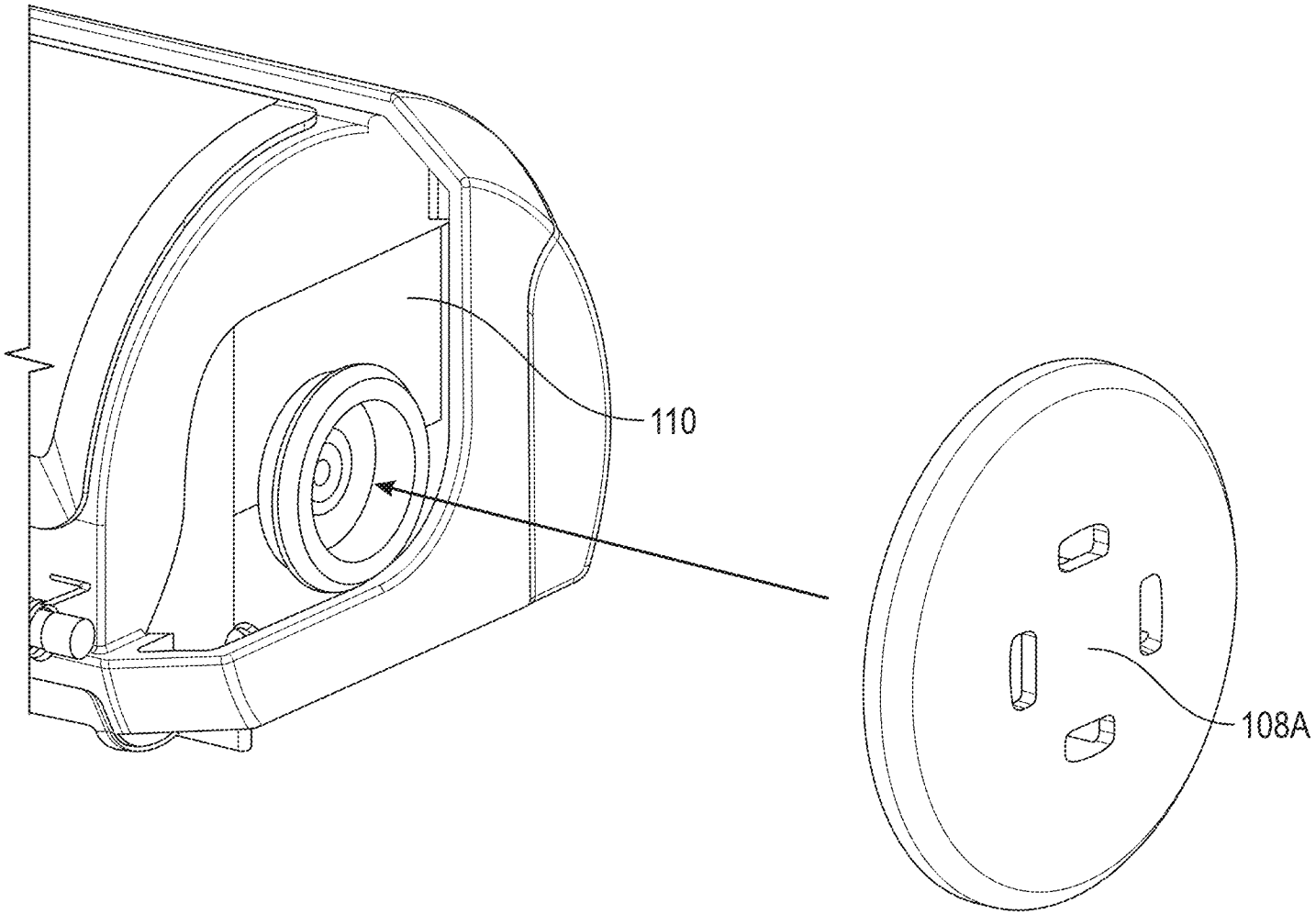
FIG. 7 illustrates a wheel of an example pet hair remover.

FIG. 7 illustrates a first wheel 108A of an example pet hair remover 100. In FIG. 7, the wheel 108A is illustrated as detached from the roller frame 110 to better show detail of the wheel's engagement with the roller frame 110. In some embodiments, the wheel 108A rotatably engages (e.g., snaps onto an exterior ring of the roller frame, as illustrated) the roller frame 110 (e.g., allowing the pet hair remover to be easily assembled, allowing a strong attachment to the roller frame as the pet hair remover contacts a surface, allowing the wheel to rotate about an axis of rotation of the roller 106). In some embodiments, the curvature of the wheel 108A is configured to facilitate the movement of the pet hair remover 100 against a surface (e.g., the curvature may reduce friction between the pet hair remover and the surface). In some embodiments, the wheel 108A is configured to rotate about an axis of rotation of the roller 106. In some embodiments, the wheel is positioned between the outer housing 136 and the roller frame 110 (e.g., as illustrated in FIG. 5).

Figure 8:
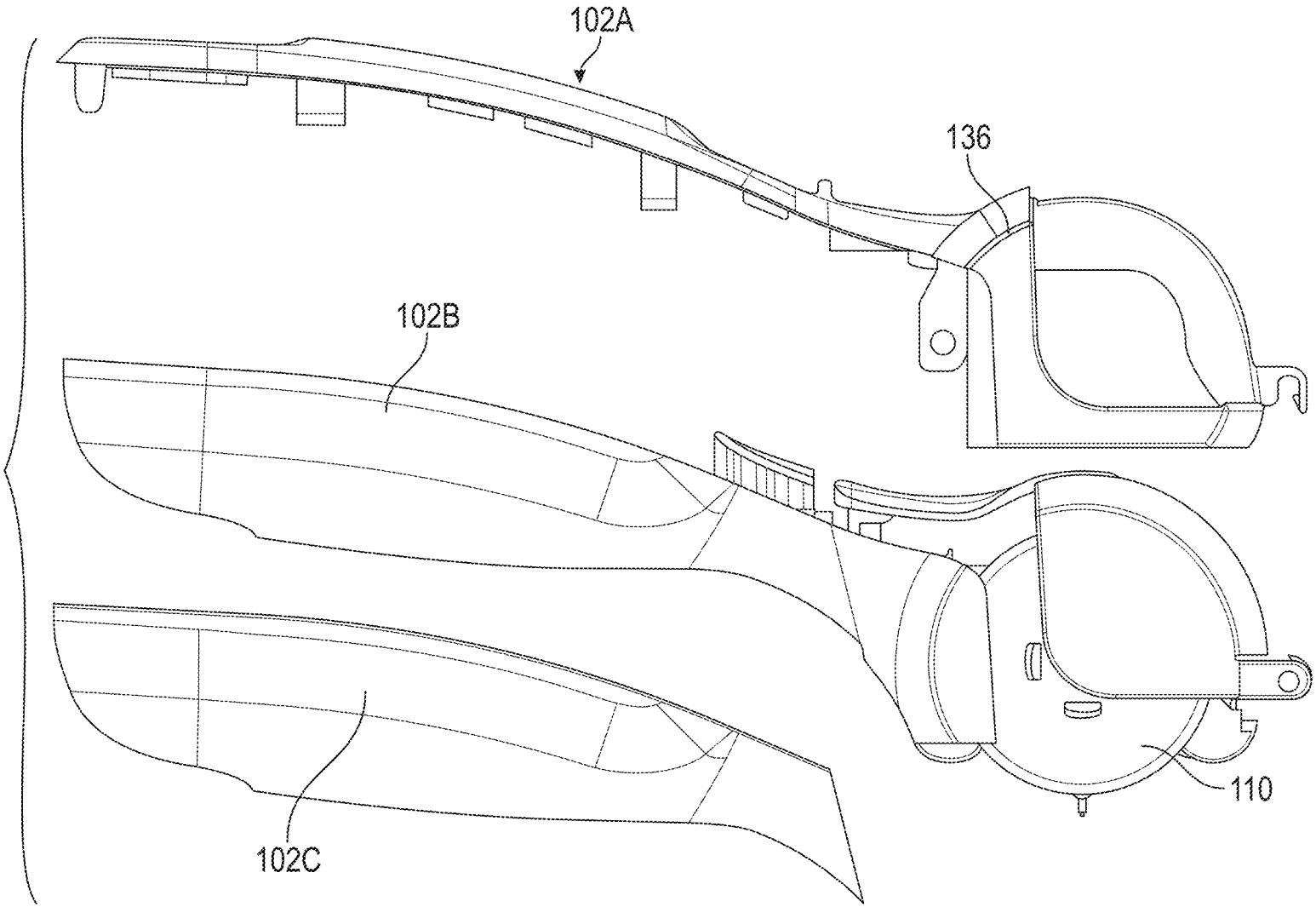
FIG. 8 illustrates a handle and housing of an example pet hair remover.

FIG. 8 illustrates a handle and housing of an example pet hair remover 100. FIG. 8 illustrates the handle and housing disassembled to better show example portions of the handle; the described portions of the handle may be assembled together to form the handle 102. In some embodiments, the handle includes an upper handle portion 102A, lower handle portion 102B, and an overmold portion 102C. As illustrated, in some embodiments, the lower handle portion 102A is configured to couple to upper handle portion 102A (e.g., the portions including features that allow them to mate together). In some embodiments, the overmold portion 102C surrounds an exterior of the lower handle portion 102B.

In some embodiments, the overmold portion 102C is softer than the upper handle portion 102B (e.g., the overmold portion 102C includes a softer material than a material of the upper handle portion 102A, a softer material has a lower corresponding durometer measurement than that of a harder material). For example, the overmold portion 102C includes thermoplastic elastomers (TPEs) and/or thermoplastic rubbers (TPRs), and the upper handle portion 102A includes acrylonitrile butadiene styrene (ABS), polypropylene (PP), ABS/polycarbonate (PC), nylon PA 66, glass filled PA6, or any combination thereof. The softer overmold portion 102C may provide additional comfort for the user while the user holds the pet hair remover, compared to a device without a softer handle portion (e.g., a handle including a same material, a handle including exposed ribs).

In some embodiments, the pet hair remover 100 includes an outer housing 136 (e.g., as described above), and the upper handle portion 102A and the outer housing 136 are integrally molded (e.g., the upper handle portion 102A and the outer housing 136 are part of one molded piece, as illustrated). In some embodiments, the lower handle portion 102B and the roller frame 110 are integrally molded (e.g., the lower handle portion 102B and the roller frame 110 are part of one molded piece). By integrally molding portions of the pet hair remover 100, less parts may be needed to assemble the pet hair remover 100, reducing assembly time and cost.

In some embodiments, a pet hair remover, comprises: a collection chamber; a roller; a handle fixed relative to the collection chamber and the roller; a roller frame fixing the roller in an axis of rotation. The roller is positioned between sides of the roller frame. The pet hair remover further comprises a door for accessing the collection chamber. The collection chamber is bounded, at least in part, by an interior surface of the door and an interior surface of the roller. The pet hair remover further comprises a blade on an exterior, curvilinear surface of the roller; and a protrusion on an exterior, planar surface of the roller. The roller's rotation is limited by the protrusion contacting the roller frame.

In some embodiments, the door is at least partially transparent to provide a view of the collection chamber.

In some embodiments, a thickness of the door is less than 9.7 mm.

In some embodiments, the roller frame comprises an intermediate edge, a first edge intersecting the intermediate edge, and a second edge intersecting the intermediate edge, and the roller's rotation is limited by the protrusion contacting the first edge and the second edge of the roller frame.

In some embodiments, the pet hair remover further comprises a spring that biases the door open; a latch that holds the door closed; and a button on the handle, the button positioned such that a maximum height of the button is at a level of a surface of the handle at a distance 1-4 mm away from the maximum height of the button. The button is movable to release the latch, and the latch is adjacent to the handle.

In some embodiments, the pet hair remover further comprises a second spring coupled to the latch; a third spring coupled to the button. The second and third springs, in their extended positions, cause the latch to hold the door close.

In some embodiments, the handle comprises an upper handle portion, a lower handle portion coupled to the upper handle portion, and an overmold portion surrounding an exterior of the lower portion.

In some embodiments, the overmold portion is softer than the upper handle portion.

In some embodiments, the pet hair remover further comprises an outer housing coupled to the roller frame. The upper handle portion and the outer housing are integrally molded, and the wheel is positioned between the outer housing and the roller frame.

In some embodiments, the lower handle portion and the roller frame are integrally molded.

In some embodiments, the pet hair remover further comprises: first and second arms coupled to the roller frame and parallel to the axis of rotation; first and second hair collection textiles on the exterior, curvilinear surface of the roller. The first and second hair collection textiles contact the first and second arms, respectively.

In some embodiments, the pet hair remover further comprises a second blade positioned between the first and second hair collection textiles.

In some embodiments, the pet hair remover further comprises first and second arms coupled to the roller frame and parallel to the axis of rotation. The roller's rotation is further limited by the blade contacting the first and second arms.

In some embodiments, the pet hair remover further comprises first and second arms coupled to the roller frame and parallel to the axis of rotation. When the protrusion contacts the roller frame, the blade does not contact the arm.

In some embodiments, the roller's rotation is limited in a first direction by the protrusion contacting a first point on the roller frame and the roller's rotation is limited in a second direction by the protrusion contacting a second point on the roller frame.

In some embodiments, the pet hair remover further comprises a second protrusion on a second exterior, planar surface of the roller. The roller's rotation is further limited by the second protrusion contacting the roller frame.

In some embodiments, the wheel rotatably engages the roller frame.

In some embodiments, the pet hair remover further comprises an outer housing comprising an interference to limit an opening of the door. The wheel is positioned between the outer housing and the roller frame.

In some embodiments, the pet hair remover further comprises a wheel. The handle is further fixed relative to the wheel, and the roller frame is positioned between the wheel and the roller.

In some embodiments, a pet hair remover comprises: a collection chamber; a roller; a handle fixed relative to the collection chamber and the roller; a roller frame fixing the roller in an axis of rotation. The roller is positioned between sides of the roller frame; a door for accessing the collection chamber. The collection chamber is bounded, at least in part, by an interior surface of the door and an interior surface of the roller, and the door is at least partially transparent to provide a view of the collection chamber. The pet hair remover further comprises a blade on an exterior, curvilinear surface of the roller.

In some embodiments, a pet hair remover comprises: a collection chamber; a roller; a handle fixed relative to the collection chamber and the roller; a roller frame fixing the roller in an axis of rotation. The roller is positioned between sides of the roller frame. The pet hair remover further comprises a door for accessing the collection chamber. The collection chamber is bounded, at least in part, by an interior surface of the door and an interior surface of the roller. The pet hair remover further comprises a blade on an exterior, curvilinear surface of the roller; a spring that biases the door open; a latch that holds the door closed; and a button on the handle, the button positioned such that an exterior surface of the button is at or below an exterior, adjacent surface of the handle. The button is movable to release the latch, and the latch is adjacent to the handle.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

The invention claimed is:

1. A pet hair remover, comprising:

a collection chamber;

a roller;

a handle fixed relative to the collection chamber and the roller;

a button on the handle;

a first spring coupled to the button;

a roller frame fixing the roller in an axis of rotation, wherein the roller is positioned between sides of the roller frame;

a door for accessing the collection chamber, wherein
the collection chamber is bounded, at least in part, by an interior surface of the door and an interior surface of the roller, and
the door comprises a door catch;
a latch for engaging with the door catch and holding the door closed;
a second spring coupled to the latch, wherein
the first and second springs, in their extended positions, cause the latch to engage with the door catch, and
an actuation of the button causes the button to push the latch away from the door catch, the pushing the latch away from the door catch causing the door to open; and
a blade on an exterior, curvilinear surface of the roller.

2. The pet hair remover of claim 1, wherein the door is at least partially transparent to provide a view of the collection chamber.

3. The pet hair remover of claim 1, wherein a thickness of the door is less than 9.7 mm.

4. The pet hair remover of claim 1, further comprising
a third spring that biases the door open,
wherein
the button is positioned such that a point of the button at a maximum height of the button is at a distance of 1-4 mm away from a surface of the handle
and
the latch is adjacent to the handle.

5. The pet hair remover of claim 1, wherein the handle comprises an upper handle portion, a lower handle portion coupled to the upper handle portion, and an overmold portion surrounding an exterior of the lower handle portion.

6. The pet hair remover of claim 5, further comprising an outer housing coupled to the roller frame, wherein
the upper handle portion and the outer housing are integrally molded, and
a wheel is positioned between the outer housing and the roller frame.

7. The pet hair remover of claim 5, wherein the lower handle portion and the roller frame are integrally molded.

8. The pet hair remover of claim 1, further comprising:
first and second arms coupled to the roller frame and parallel to the axis of rotation;
first and second hair collection textiles on the exterior, curvilinear surface of the roller, wherein
the first and second hair collection textiles contact the first and second arms, respectively.

9. The pet hair remover of claim 8, further comprising a second blade positioned between the first and second hair collection textiles.

10. The pet hair remover of claim 1, further comprising first and second arms coupled to the roller frame and parallel to the axis of rotation, wherein
the roller's rotation is-further limited by the blade contacting the first and second arms.

11. The pet hair remover of claim 1, further comprising a wheel, wherein the wheel rotatably engages the roller frame.

12. The pet hair remover of claim 1, further comprising: a wheel; and an outer housing comprising an interference to limit an opening of the door, wherein the wheel is positioned between the outer housing and the roller frame.

13. The pet hair remover of claim 1, further comprising a wheel, wherein
the handle is further fixed relative to the wheel, and
the roller frame is positioned between the wheel and the roller.

14. The pet hair remover of claim 1, further comprising a protrusion on an exterior, planar surface of the roller, wherein the roller's rotation is limited by the protrusion contacting the roller frame.

15. The pet hair remover of claim 14, wherein
the roller frame comprises an intermediate edge, a first edge intersecting the intermediate edge, and a second edge intersecting the intermediate edge, and
the roller's rotation is limited by the protrusion contacting the first edge and the second edge of the roller frame.

16. The pet hair remover of claim 14, further comprising first and second arms coupled to the roller frame and parallel to the axis of rotation, wherein when the protrusion contacts the roller frame, the blade does not contact the first and second arms.

17. The pet hair remover of claim 14, wherein the roller's rotation is limited in a first direction by the protrusion contacting a first point on the roller frame and the roller's rotation is limited in a second direction by the protrusion contacting a second point on the roller frame.

18. The pet hair remover of claim 14, further comprising a second protrusion on a second exterior, planar surface of the roller, wherein the roller's rotation is further limited by the second protrusion contacting the roller frame.

* * * * *